US006318355B2

(12) United States Patent
Shiga

(10) Patent No.: US 6,318,355 B2
(45) Date of Patent: Nov. 20, 2001

(54) CASE FOR STORING A GRINDING WHEEL

(75) Inventor: Yoshiyuki Shiga, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 09/725,039

(22) Filed: Nov. 29, 2000

(30) Foreign Application Priority Data

Nov. 30, 1999 (JP) ..... 11-339997

(51) Int. Cl.[7] ..... B24B 55/04
(52) U.S. Cl. ..... 125/35; 206/380; 451/451
(58) Field of Search ..... 451/344, 451, 451/557; 125/35; 206/224

(56) References Cited

U.S. PATENT DOCUMENTS 5,853,087 * 12/1998 Sos et al. ..... 206/380
5,887,720 * 3/1999 Lin ..... 206/702
6,021,891 * 2/2000 Anderson ..... 206/214
6,026,960 * 2/2000 Cogliano ..... 206/575

* cited by examiner

*Primary Examiner*—Joseph J. Hail, III
*Assistant Examiner*—Anthony Ojini
(74) *Attorney, Agent, or Firm*—Smith, Gambrell & Russell, LLP

(57) ABSTRACT

A case for storing a grinding wheel which comprises an annular support member and a grinding means provided on the lower end face of the support member. The case includes a first case member and a second case member, the first case member and the second case member are connected to each other by a hinge member in such a manner that they can pivote relative to each other and selectively set to a close state for defining a closed storage space and to an open state for opening the storage space. A receiving means is provided on the first case member and a restricting means is provided on the second case member. The support member is held between the receiving means and the restricting means, and the grinding wheel is stored in the storage space, without allowing the first case member and the second case member to contact with the grinding means.

12 Claims, 6 Drawing Sheets

CASE FOR STORING A GRINDING WHEEL

FIELD OF THE INVENTION

The present invention relates to a case for storing a grinding wheel which is advantageously used to grind the rear surface of a semiconductor wafer.

DESCRIPTION OF THE PRIOR ART

As is known among people skilled in the art, a grinding wheel comprising a support member and a grinding means is advantageously used as a tool for grinding the rear surface of a semiconductor wafer. The support member which can be formed of an appropriate metal such as aluminum is annular and has an upper end face, lower end face, outer side face and inner side face. The grinding means fixed to the lower end face of the support member may be formed of a plurality of circular arc-shaped grinding pieces which are arranged in a circumferential direction at intervals or a single annular grinding piece which extends continuously in a loop. The grinding piece can be advantageously formed by bonding abrasive diamond grains by an appropriate bonding material such as a resin bond.

The above-described grinding wheel is generally stored in a case to be preserved or placed on the market. A typical example of the case comprises a rectangular box member whose top side is open and a cover member which is combined with this box member to close the top side of the box member. The box member and the cover member are each separately formed from a foaming synthetic resin such as polystyrene foam. The grinding wheel is wrapped in an appropriate film such as a synthetic resin film as required and stored in the box member which is then combined with the cover member.

However, the above case of the prior art involves the following problems to be solved.

(1) Although the grinding of the rear surface of a semiconductor wafer is generally carried out in a so-called clean room, powders, chippings or the like are produced from the box member and/or the cover member by friction generated at the time of handling the box member and/or the cover member made from a foaming synthetic resin, with the result that the clean room may be polluted.

(2) To provide sufficient strength to the box member and the cover member made from a foaming synthetic resin, the box member and the cover member must be made very thick, with the result that the size of the case becomes considerably large.

(3) The grinding wheel stored in the case cannot be seen.

(4) The inner side of the box member and/or the cover member contacts the grinding means of the grinding wheel due to the deformation of the box member and/or the cover member, with the result that the grinding means may be damaged.

(5) When a plurality of cases storing the grinding wheel are piled up in a vertical direction, it is likely that the cases may be shifted from one another and damaged by relatively small external force.

(6) The cover member may be separated from the box member accidentally when it is merely combined with the box member. Therefore, after the cover member is combined with the box member, it is necessary to hold the box member and the cover member together by wrapping them with a synthetic resin tape, for example.

SUMMARY OF THE INVENTION

It is a principal object of the present invention to provide a novel and improved case for storing a grinding wheel, which solves at least some of the above problems of the conventional cases for storing a grinding wheel.

According to the present invention, there is provided a case for storing a grinding wheel which comprises an annular support member having an upper end face, lower end face, outer side face and inner side face and a grinding means provided on the lower end face of the support member, wherein the case includes a first case member and a second case member, and the first case member and the second case member are connected to each other by a hinge member in such a manner that they can pivote relative to each other and selectively set to a close state for defining a closed storage space in cooperation or to an open state for opening the storage space;

a receiving means is provided on the first case member and a restricting means is provided on the second case member; and when the upper end face of the support member is placed on the receiving means of the first case member by setting the first case member and the second case member to the open state and then the first case member and the second case member are set to the close state, the restricting means of the second case member comes into contact with either one of the inner side face, lower end face and outer side face of the support member, whereby the support member is held between the receiving means and the restricting means and the grinding wheel is stored in the storage space without contacting the first case member and the second case member to the grinding means.

Preferably, the first case member, the second case member and the hinge member are each molded out of a transparent or semi-transparent synthetic resin as a single piece. In a preferred embodiment, the first case member has a main wall and a side wall protruding from the periphery of the main wall, a plurality of receiving pieces are arranged on the inner side of the main wall in a circumferential direction at intervals, and the top surfaces of the receiving pieces constitute the receiving means. The inner side face of the support member includes an inclined face which is inclined inward in a radial direction and extends from the lower end face toward the upper end face, the restricting means of the second case member has restricting faces which are inclined inward in a radial direction and extend toward the end, and the restricting faces are contacted to the inclined face of the support member. The second case member has a main wall and a side wall protruding from the periphery of the main wall, and the restricting means consists of a plurality of restricting pieces arranged on the inner side of the main wall in a circumferential direction at intervals. A first receiving mean for receiving a support member having a relatively large thickness in a radial direction and a second receiving means for receiving a support member having a relatively small thickness in a radial direction are formed on the first case member, a first restricting means to be contacted with either one of the inner side face, lower end face and outer side face of the support member having a relatively large thickness in a radial direction is formed on the second case member, and an auxiliary member constituting a second restricting means to be contacted with either one of the inner side face, lower end face and outer side face of the support member having a relatively small thickness in a radial direction is set in the second case member detachably. Preferably, the first case member has a main wall and a side wall protruding from the periphery of the main wall, a plurality of receiving pieces are arranged on the inner side of the main wall in a circumferential direction at intervals, a storage groove is formed in a center portion of the top surface of each of the receiving pieces, the top surfaces of the receiving pieces constitute the first receiving means, and the storage grooves of the receiving pieces constitute the second receiving means. Preferably, the first case member has a main wall which has a semicircular front half portion and a rectangular rear half portion continuous to a linear site of the front half portion and a side wall protruding from the periphery of the main wall, the second case member also has a main wall which has a semicircular front half portion and a rectangular rear half portion continuous to a linear site of the front half portion, correspondingly to the main wall of the first case member, and a side wall protruding from the periphery of the main wall, and the hinge member connects an upper end portion of the rear end of the side wall of the first case member to an upper end portion of the rear end of the side wall of the second case member. A locking means can be formed on a front end portion of the side wall of the first case member and a front end portion of the side wall of the second case member to lock the case releasably to set, in cooperation with each other, the first case member and the second member to the close state. When the grinding wheel is stored in the storage space and the first case member and the second case member are set to the close state, the center of gravity of the case storing the grinding wheel is preferably located behind the semicircular geometrical center of the front half portion of the main wall of the first case member and the front half portion of the main wall of the second case member. Rotation prevention elongated ribs may be provided on the outer side of the both side linear portions of the side wall of the first case member and/or the outer side of the both side linear portions of the side wall of the second case member. In a preferred embodiment, a protruding area whose both sides are linear is formed on either one of the outer side of the main wall of the first case member and the outer side of the main wall of the second case member, and a sunken area whose both sides are linear and whose front end and rear end are made open is formed on the opposite side corresponding to the protruding area.

DETAILED DESCRIPTION OF THE PREFERRED EMBODIMENTS

A case constituted according to a preferred embodiment of the present invention will be described in more detail with reference to the accompanying drawings.

Figure 1:
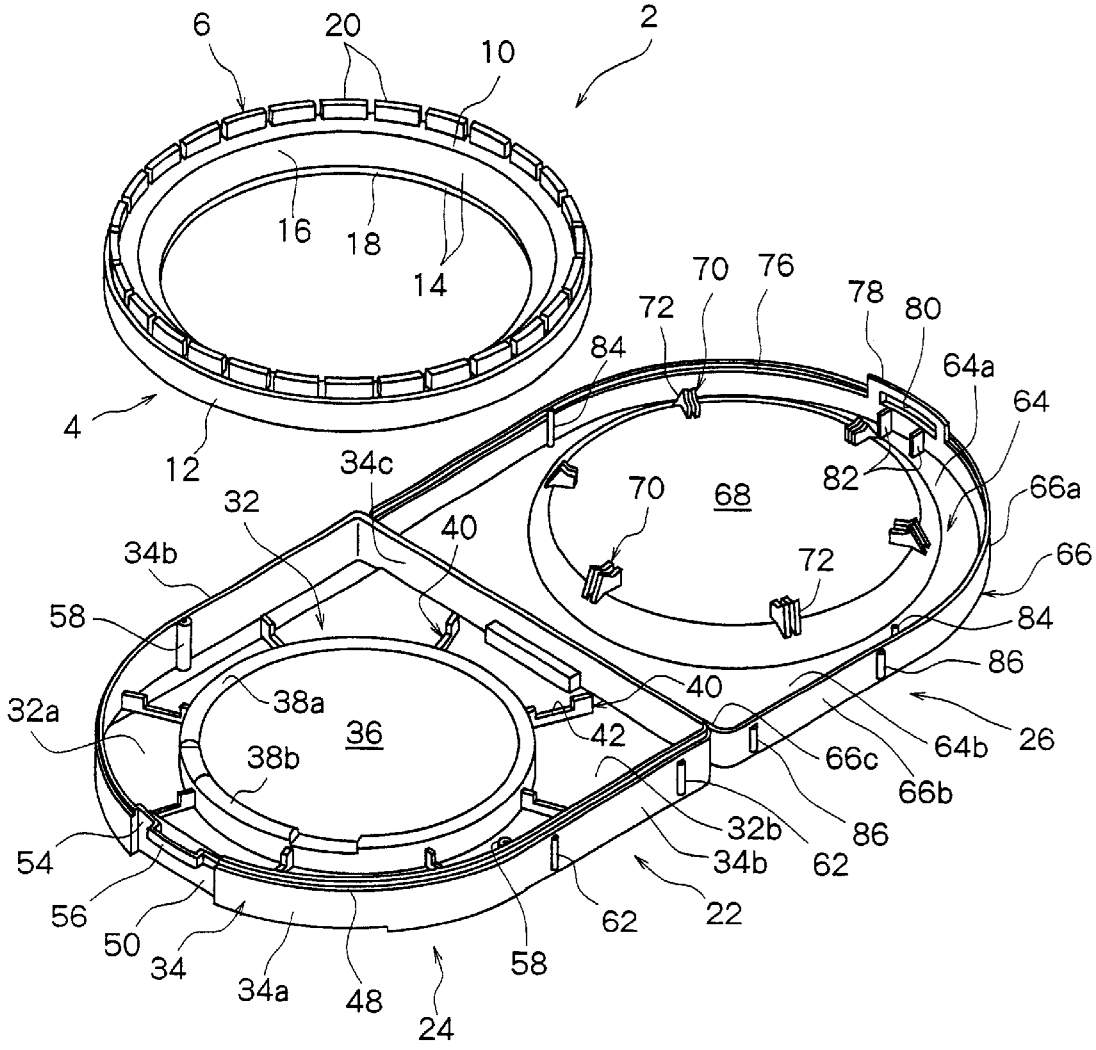
FIG. 1 is a perspective view of a case constituted according to a preferred embodiment of the present invention in an open state together with a typical example of grinding wheel to be stored in the case.

FIG. 1 shows a typical example of a grinding wheel and the case for storing this grinding wheel constituted to the preferred embodiment of the present invention (the grinding wheel is shown in a state of being inverted).

Figure 2:
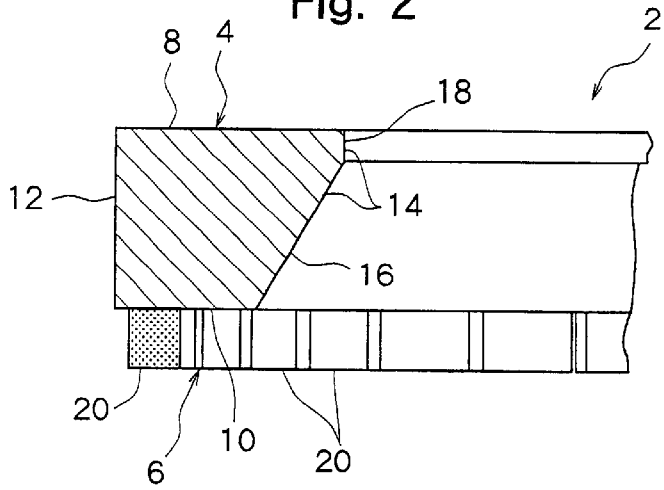
FIG. 2 is a sectional view of the grinding wheel shown in FIG. 1.

First describing the grinding wheel denoted by 2 as a whole with reference to FIG. 1 and FIG. 2, the illustrated grinding wheel 2 comprises an annular support member 4 and a grinding means 6. The support member 4 which can be formed from an appropriate metal material such as aluminum has a nearly trapezoidal section and has an upper end face 8, lower end face 10, outer side face 12 and inner side face 14. The upper end face 8 and the lower end face 10 are flat faces parallel to each other and extending substantially vertically. The outer side face 12 extends substantially in a vertical direction. The inner side face 14 includes an inclined face 16 which is inclined inward in a radial direction and extends from the lower end face 10 toward the upper end face 8, and a vertical face 18 continuous to this inclined face 16 and extending substantially vertically. The grinding means 6 consists of a plurality of grinding pieces 20 which are fixed to the lower end face 10 of the support member 4 and arranged in a circumferential direction at intervals. Each of the grinding pieces 20 extends in a circular arc form and has a rectangular section. The grinding pieces 20 can be each advantageously formed by bonding abrasive diamond grains by a resin bond, for example. The grinding pieces 20 are prepared separately from the support member 4 and can be bonded to the lower end face 10 of the support member 4. A single grinding piece which extends continuously in a loop may be formed on the lower end face 10 of the support member 4 in place of the plurality of grinding pieces 20 extending in a circular arc form as desired.

As is known among people skilled in the art, the above-described grinding wheel 2 grinds the rear surface of a semiconductor wafer by fixing the support member 4 to the lower end of a rotary support shaft (not shown) extending substantially vertically and causing the grinding means 6 to work on the rear surface of the semiconductor wafer (not shown) while the shaft is rotated at a high speed.

Figure 3:
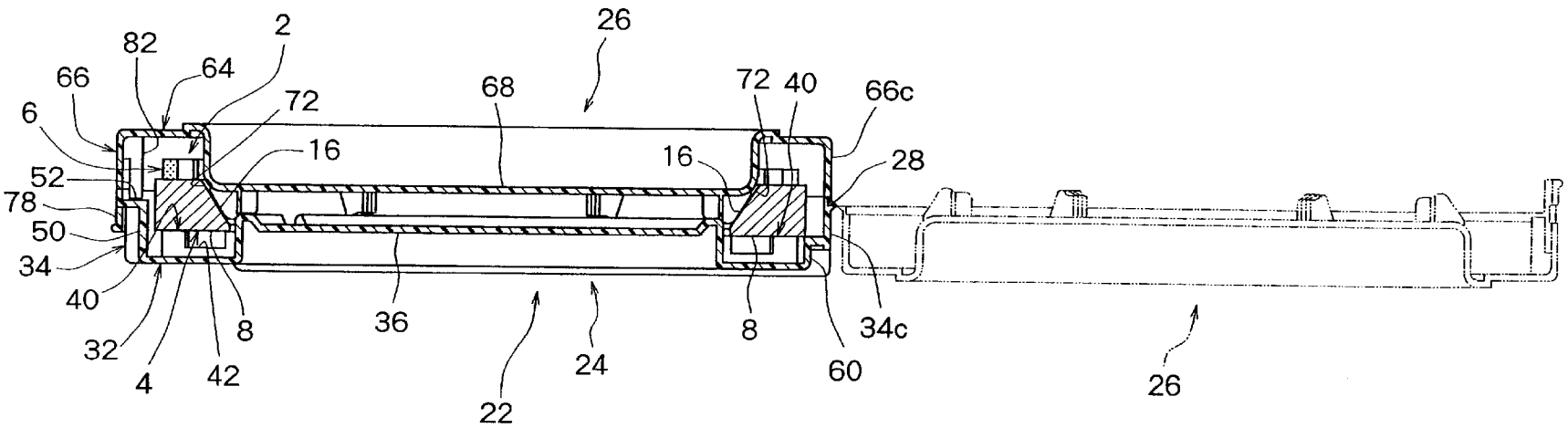
FIG. 3 is a sectional view of the grinding wheel stored in the closed case shown in FIG. 1.

Continuing explanation with reference to FIG. 1 and FIG. 3, a case denoted by 22 as a whole includes a first case member 24, a second case member 26 and a hinge member 28. The first case member 24, second case member 26 and hinge member 28 of the case 22 are each molded out of an appropriate synthetic resin such as polypropylene or polyethylene as a single piece and in particular, polypropylene is preferable from viewpoints of the mechanical strength and recycling use. The first case member 24 and the second case member 26 are connected to each other by the hinge member 28 in such a manner that they can freely pivote and selectively set to an open state shown by solid lines in FIG. 1 and two-dot chain lines in FIG. 3 and to a close state shown by solid lines in FIG. 3. The first case member 24, the second case member 26 and the hinge member 28 are preferably transparent or semi-transparent so that the grinding wheel 2 stored in the case 22 can be seen from the outside of the case 22. As will be mentioned hereinafter, when the first case member 24 and the second case member 26 are set to the above close state, the first case member 24 and the second case member 26 in cooperation define a closed storage space for storing the grinding wheel 2, and when the first case member 24 and the second case member 26 are set to the above open state, the above storage space is made open.

Figure 5:
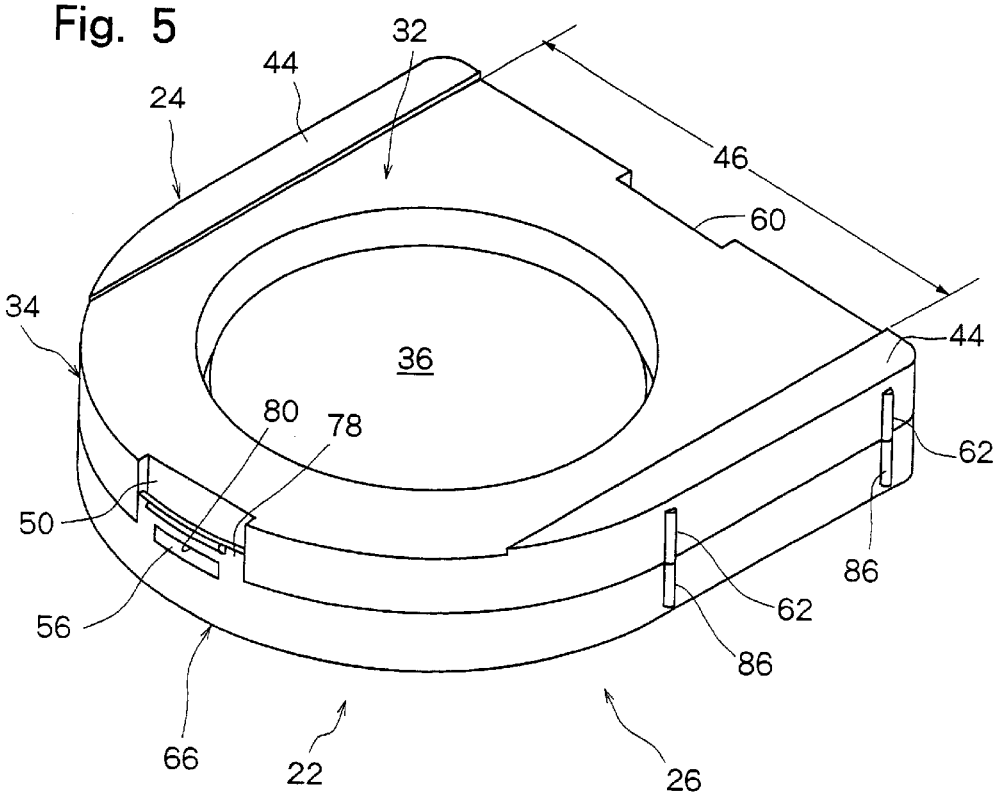
FIG. 5 is a perspective view of the closed case shown in FIG. 1 when seen from a first case member side.

The first case member 24 is constituted by a main wall 32 and a side wall 34. The main wall 32 has a semicircular front half portion 32*a* and a rectangular rear half portion 32*b* continuous to a linear site of the front half portion 32*a*. A circular indented portion 36 sinking inward, namely upward in FIG. 1 and FIG. 3, is formed in a center portion of the main wall 32. This circular indented portion 36 defines a circular indented portion on the outer side of the main wall 32 (refer to FIG. 5) and a circular protruding portion on the inner side of the main wall 32. The circular indented portion 36 is substantially concentric to the semicircular front half portion 32*a* of the main wall 32. Arc-shaped protruding rims 38*a* and 38*b* which extend in a circular arc form are formed at the periphery of the circular indented portion 36. The peripheral portion of the circular indented portion 36 is flush with the top surface of the main portion of the circular indented portion 36 between the arc-shaped protruding rims 38*a* and 38*b*. A plurality (8 in the drawing) of receiving pieces 40 are formed around the circular indented portion 36 on the inner side of the main wall 32 in such a manner that they are arranged in a circumferential direction at intervals. The receiving pieces 40 are shaped like plates which extend radially between the circular indented portion 36 and the side wall 34 and a storage groove 42 which may be a rectangular cut-way is formed in a center portion of the top end of each of the receiving pieces 40. As will be clearly understood from a description given hereinafter, the top ends of the receiving pieces 40 (excluding the storage grooves 42) constitute a first receiving means on which the support member 4 of the grinding wheel 2 shown in FIG. 1 is mounted. The storage grooves 42 formed in the top ends of the receiving pieces 40 constitute a second receiving means on which the support member 104 (FIG. 7) of a grinding wheel 102 (FIG. 7) smaller than the grinding wheel 2 shown in FIG. 1 is mounted when the grinding wheel 102 is to be stored in the case 22. As is clearly understood by referring to FIG. 5, protruding areas 44 which are slightly displaced outward are formed in the end portions on both sides of the main wall 32 and a sunken area 46 is defined between the protruding areas 44. Both sides of the sunken area 46 extend linearly in front and rear directions and the front end and rear end of the sunken area 46 are made open (the function of the sunken area 46 will be described hereinafter).

The side wall 34 of the first case member 24 extends upright from the periphery of the main wall 32 and includes a front half portion 34*a* extending in a semicircular form, two linear both side portions 34*b* which extend backward in a straight line from the both ends of the front half portion 34*a*, and a rear end portion 34*c* which extends between the linear both side portions 34*b*. An end portion of the side wall 34 is made slightly thin excluding a central front end portion of the front half portion 34*a*, the inner side face of the sidewall 34 extends substantially vertically from the proximal end to the distal end, and a shoulder face 48 extending continuously is formed on the outer side of the side wall 34 excluding the central front end portion of the front half portion 34*a*. A recessed portion 50 which is recessed inward from the shoulder face 48 is formed in the central front end portion of the front half portion 34*a* of the side wall 34, and a substantially horizontal shoulder face 52 facing upward is formed on the central front end portion of the front half portion 34*a* of the side wall 34. Above the recessed portion 50, two small recessed portions 54 are arranged in a circumferential direction with a space therebetween to define an arc-shaped piece 56 between the recessed portions 54 (this arc-shaped piece 56 constitutes a locking means as will be clearly understood from a description given hereinafter). Columns 58 extending vertically in boundary areas between the front half portion 34*a* and the both side portions 34*b* are formed on the inner side of the side wall 34. A blind hole extending downward from the top surface is formed in each of the columns 58. As is clearly understood with reference to FIG. 5 together with FIG. 1 and FIG. 3, a rectangular recessed portion 60 which is recessed inward is formed in a central lower half portion of the rear end portion 34*c* of the side wall 34. Further, in the illustrated embodiment, two rotation prevention elongated ribs 62 extending substantially vertically are formed on the outer side of each of the both side portions 34*b* of the side wall 34.

Figure 4:
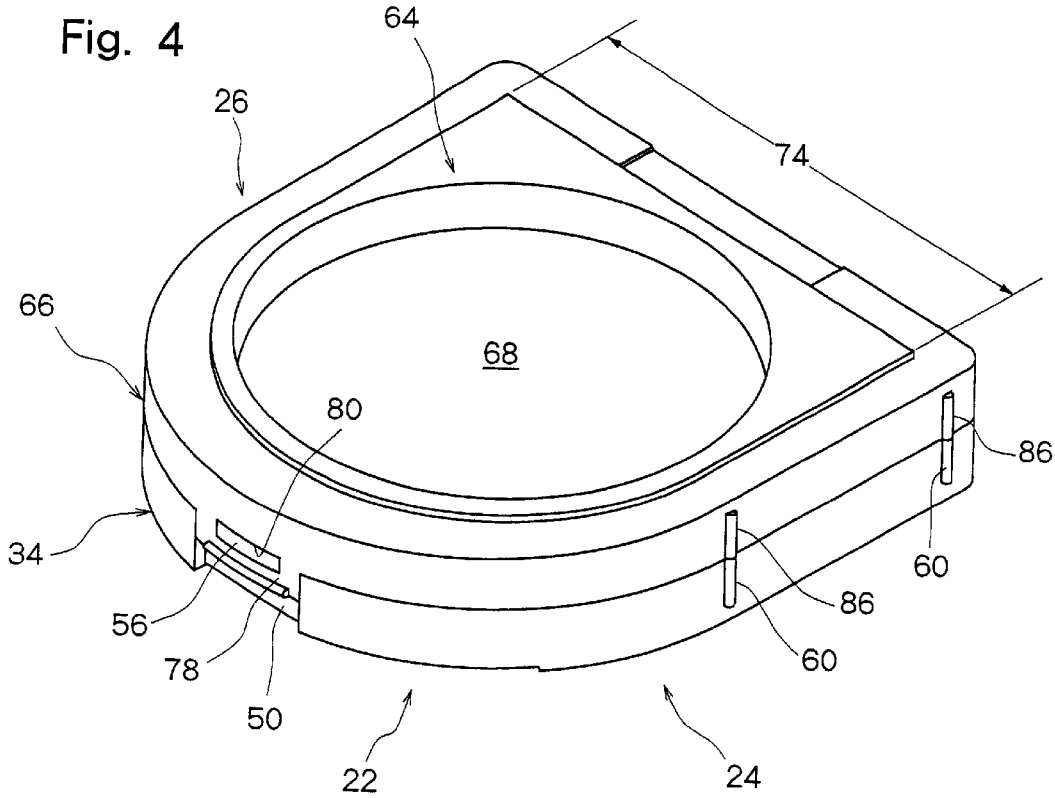
FIG. 4 is a perspective view of the closed case shown in FIG. 1 when seen from a second case member side.

Continuing explanation with reference to FIG. 1 and FIG. 3, the second case member 26 is also constituted by a main wall 64 and a side wall 66. Like the main wall 32 of the first case member 24, the main wall 64 has a semicircular front half portion 64a and a rectangular rear half portion 64*b* continuous to a linear site of the front half portion 64*a*. A circular indented portion 68 sinking inward, namely upward in FIG. 1 and downward in FIG. 3, is formed in a center portion of the main wall 64. The diameter of the circular indented portion 68 is slightly larger than the diameter of the above-described circular indented portion 36 formed in the main wall 32 of the first case member 24. This circular indented portion 68 defines a circular indented portion (refer also to FIG. 4) on the outer side of the main wall 64 and a circular protruding portion on the inner side of the main wall 64. The circular indented portion 68 is substantially concentric to the semicircular front half portion 64*a* of the main wall 64. A plurality of restricting pieces 70 are formed on the peripheral portion of the inner side of the circular indented portion 68. In the illustrated embodiment, 6 pairs of restricting pieces 70 are arranged in a circumferential direction at relatively large intervals. Two restricting pieces 70 of each pair are situated in close vicinity to each other. Each of the restricting pieces 70 is shaped like a plate protruding inward, namely upward in FIG. 1 and downward in FIG. 3 from the peripheral portion of the inner side of the circular indented portion 68. Each of the restricting pieces 70 has a inclined side 72 inclined inward in a radial direction, and the inclined side 72 constitutes a restricting face for the support member 4 of the grinding wheel 2 as will be clearly understood from a description given hereinafter. As is understood with reference to FIG. 8 together with FIG. 1 and FIG. 3, two restricting pieces 70 of each pair which are situated in close vicinity to each other are connected to each other by a connection wall 73. As clearly shown in FIG. 4, the main wall 64 is slightly displaced outward in an area outside the above circular indented portion 68 to define a protruding area 74. This protruding area 74 is similar to the outer shape of the main wall 64 and the both side rear half portions extend substantially linearly. The width between the both side rear half portions is equivalent to the width of the sunken area 46 formed on the outer side of the first case member 24.

The side wall 66 of the first case member 26 also extends upright from the periphery of the main wall 64 and includes a front half portion 66*a* extending in a semicircular form, two linear both side portions 66*b* which extend backward in a straight line from the both ends of the front half portion 66*a*, and a rear end portion 66*c* which extends between the linear both side portions 66*b*. An end portion of the side wall 66 is made slightly thin excluding a central front end portion of the front half portion 66*a*, the outer side face of the side wall 66 extends substantially vertically from the proximal end to the distal end, and a shoulder face 76 extending continuously is formed on the inner side of the side wall 66 excluding the central front end portion of the front half portion 66*a*. A protruding piece 78 protruding upward in FIG. 1 and downward in FIG. 3 is formed on the central front end portion of the front half portion 66*a* of the side wall 66. A slit 80 extending in a horizontal direction is formed in the protruding piece 78. As will be mentioned hereinafter, the slit 80 corresponds to the above arc-shaped piece 56 of the first case member 24, and the slit 80 and the arc-shaped piece 56 in cooperation constitute a locking means. Plate-like pieces 82 extending substantially vertically are arranged on the inner side of the central front end portion of the front half portion 66*a* of the side wall 66 in a circumferential direction at a distance. Cylindrical columns 84 extending vertically are formed in boundary areas between the front half portion 66*a* and the both side portions 66*b* on the inner side of the side wall 66. The columns 84 are slightly protruded beyond the shoulder face 76 formed on the inner surface of the side wall 66. Further, two rotation prevention elongated ribs 86 extending substantially vertically are formed on the outer side of each of the both side portions 66*b* of the side wall 66.

The hinge member 28 is composed of a thin plate-like piece for connecting between the outer side of the rear end portion 34*c* of the side wall 34 of the first case member 24 and the outer side of the rear end portion 66*c* of the side wall 66 of the second case member 26. When the hinge member 28 bends on a rotating axis extending in a longitudinal direction as the center, the first case member 24 and the second case member 26 pivote relative to each other, whereby the first case member 24 and the second case member 26 are selectively set to an open state shown by solid lines in FIG. 1 and two-dot chain lines in FIG. 3 and to a close state shown by solid lines in FIG. 3.

Continuing explanation with reference to FIGS. 1 to 3, the grinding wheel 2 is stored in the case 22 with the upper end face 8 of the support member 4 being situated on the receiving pieces 40 of the first case member 24 while the grinding wheel 2 is in a state of being inverted, that is, in a state that the upper end face 8 of the support member 4 faces downward. Thereafter, the second case member 26 is turned to a position shown by solid lines in FIG. 3 from an open position shown by two-dot chain lines in FIG. 3 to close the case 22. When the second case member 26 is turned to the close position, the thin end portion of the side wall 34 of the first case member 24 and the thin end portion of the side wall 66 of the second case member 26 are placed one upon the other, the top end of the side wall 34 of the first case member 24 is contacted or moved close to the shoulder face 76 of the side wall 66 of the second case member 26, and the top end of the side wall 66 of the second case member 26 is contacted or moved close to the shoulder face 48 of the side wall 34 of the first case member 24. The protruding piece 80 formed on the second case member 26 is elastically deformed slightly outward, its end portion passes over the arc-shaped piece 56 formed on the first case member 24, the arc-shaped piece 56 is inserted into the slit 78 in the protruding piece 80, and the protruding piece 80 is elastically returned to its original state, whereby the second case member 26 is locked in the first case member 24 at a closed position in such a manner that it can be unlocked freely. Further, the top ends (lower ends in FIG. 3) of the plate-like pieces 82 of the second case member 26 are contacted or moved close to the shoulder face 52 defined by the recessed portion 50 of the first case member 24. The end portions of the columns 84 formed on the second case member 26 are inserted into the blind holes of the columns 58 formed on the first case member 24. The first case member 24 and the second case member 26 are thus situated in a close state as desired with high accuracy.

As is understood with reference to FIG. 1 and FIG. 3, when the second case member 26 is turned to the close position, the inclined sides 72 of the plurality of restricting pieces 70 provided on the second case member 26 are contacted to the inclined face 16 of the inner side face 14 of the support member 4 of the grinding wheel 2 mounted on the receiving pieces 40 of the first case member 24. Thus, the support member 4 of the grinding wheel 2 is held between the receiving pieces 40 of the first case member 24 and the restricting pieces 72 of the second case member 26. As is clearly understood with reference to FIG. 3, any part of the first case member 24 and any part of the second case member 26 are not contacted to the grinding means 6 of the grinding wheel 2, thereby eliminating the possibility that the grinding means 6 is damaged when the grinding wheel 2 is stored in the case 22. When the grinding wheel 2 is stored as desired and the first case member 24 and the second case member 26 are set to a close state, a slight space is left between the circular indented portion 36 of the first case member 24 and the circular indented portion 68 of the second case member 26. Therefore, a paper sheet indicating the characteristic properties and the like of the grinding wheel 2 can be stored in the space between the circular indented portion 36 and the circular indented portion 68, particularly a space defined by the inner sides of the arc-shaped protruding rims 38*a* and 38*b* formed on the circular indented portion 36.

In the illustrated embodiment, when the second case member 26 is turned to the close position, the restricting pieces 72 of the second case member 26 come into contact with the inclined face 16 of the inner side face 14 of the support member 4 of the grinding wheel 2. Restricting pieces contacting to other portion of the inner side face 14 of the support portion 4 of the grinding wheel 2 or the lower end face 10 or the outer side face 12 of the support member 4 of the grinding wheel 2 may be provided on the second case member 26 as desired.

Figure 6:
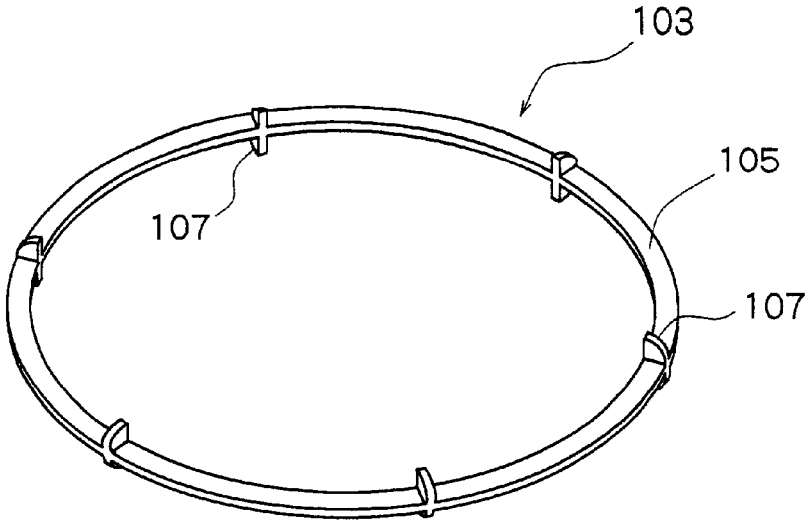
FIG. 6 is a perspective view of an auxiliary member used for the case shown in FIG. 1.
Figure 7:
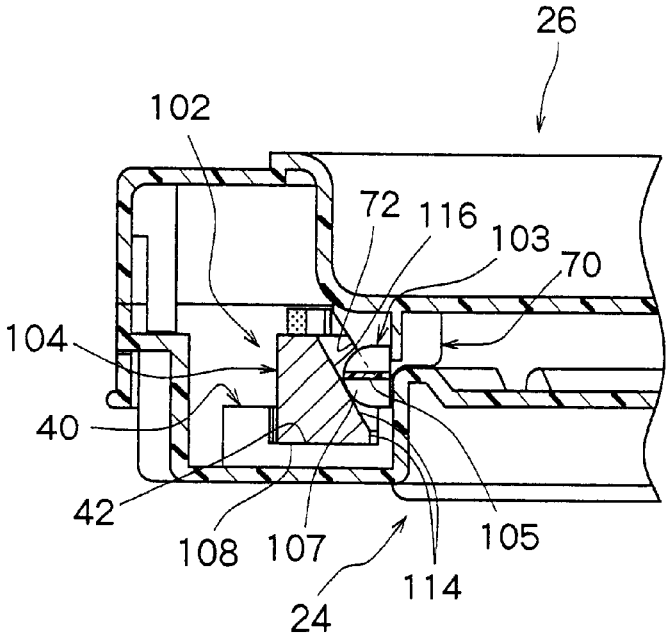
FIG. 7 is a partially sectional view showing a small-sized grinding wheel stored in the case shown in FIG. 1 using the auxiliary member.
Figure 8:
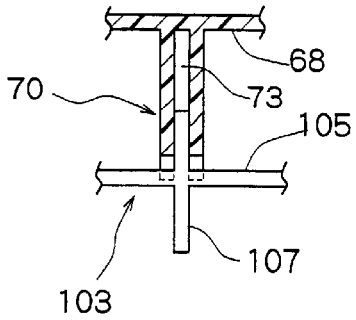
FIG. 8 is a partially sectional view showing that the auxiliary member is mounted in the case shown in FIG. 1.

The illustrated case 22 is constituted such that it can selectively store a small-sized grinding wheel 102 (FIG. 7) which is smaller than the grinding wheel 2 shown in FIGS. 1 to 3 and substantially similar in shape to the grinding wheel 2 shown in FIGS. 1 to 3 in place of the grinding wheel 2 shown in FIGS. 1 to 3. FIG. 6 shows an auxiliary member 103 used to assist the storage of the small-sized grinding wheel 102. The auxiliary member 103 which can be molded out of an appropriate resin such as polypropylene or polyethylene has a main portion 105 which is shaped like an annular plate and a plurality (6 in the illustrated embodiment) of working pieces 107 arranged on the main portion 105 in a circumferential direction at intervals. Each of the working pieces 107 has a one side portion protruding from one side of the main portion 105 and the other side portion protruding from the other side of the main portion 105. Each of the working pieces 107 is shaped like a half disk and its inner edge is linear and its outer edge is semicircular. To store the small-sized grinding wheel 102 in the case 22, as shown in FIG. 7 and FIG. 8, the auxiliary member 103 is mounted in the second case member 26. Describing in more detail, the auxiliary member 103 is mounted in the second case member 26 by inserting the one side portion of each of the six working pieces 107 into a space between each pair of six restricting pieces 70 formed on the second case member 26. The space between each pair of restricting pieces 70 is made slightly smaller than the thickness of each of the working pieces 107, and when each of the working pieces 80 is forcedly inserted into the space between each pair of restricting pieces 70, each of the working pieces 107 is elastically held between each pair of restricting pieces 70.

As clearly shown in FIG. 7, the support member 104 of the small-sized grinding wheel 102 is smaller in size than the support member 4 of the grinding wheel 2, and the thickness in a radial direction of the support member 104 is smaller than the thickness in a radial direction of the support member 4. The grinding wheel 102 is set in the first case member 24 with the upper end face 108 of the support member 104 being situated in the storage grooves 42 formed in the receiving pieces 40 of the first case member 24 while the grinding wheel 102 is in a state of being inverted, that is, in a state that the upper end face 108 of the support member 104 thereof faces downward. When the second case member 26 is turned to the close position, the arc-shaped ends of the other side portions 4 of the working pieces 107 formed on the auxiliary member 103 come into contact with the inclined face 116 of the inner side face 114 of the support member 104. The support member 104 of the small-sized grinding wheel 102 is thus held between the storage grooves 42 and the working pieces 107. Therefore, the storage grooves 42 constitute a receiving means for the small-sized grinding wheel 102, and the auxiliary member 103 having the working pieces 107 constitutes a restricting means for the small-sized grinding wheel 102.

Figure 9:
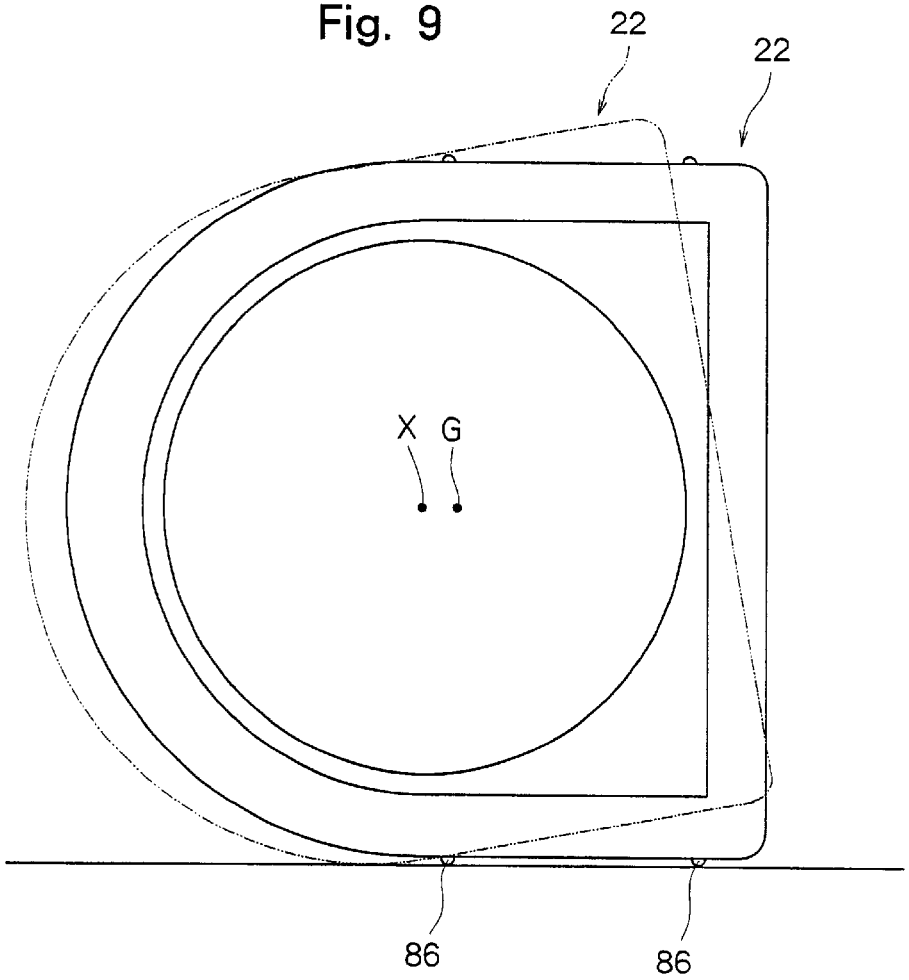
FIG. 9 is a side view showing the case shown in FIG. 1 arranged upright.

The case 22 storing the grinding wheel 2 or 102 can be installed at a desired place while it is laid horizontally as shown in FIG. 3 or FIG. 7, that is, the main wall 32 of the first case member 24 and the main wall 64 of the second case member 26 are laid horizontally. Alternatively, it may be installed at a desired place while it is arranged vertically as shown in FIG. 9, that is, the main wall 32 of the first case ember 24 and the main wall 64 of the second case member 26 stand upright. When the case 22 is installed upright on the surface of a base, the two rotation prevention elongated ribs 62 formed on the one side portion 34*b* of the side wall 34 of the first case member 24 and the two rotation prevention elongated ribs 86 formed on the one side portion 66*b* of the side wall 66 of the second case member 26 are contacted to the surface of the support base. Since both the main wall 32 of the first case member 24 and the main wall 64 of the second case member 26 have a semicircular front half portion and a rectangular rear half portion, the center of gravity G of the case 22 is located behind (right direction in FIG. 9) the geometrical center X (center of a semicircular arc) of the semicircular front half portions of the main walls 32 and 64 even when the grinding wheel 2 or 102 is stored. Therefore, even when the case 22 is installed on the surface of the support base while it is inclined slightly forward as shown by a two-dot chain line in FIG. 9, it is turned in a clockwise direction in FIG. 9 and automatically set to a stable state as shown by solid lines without being inclined further forward.

Figure 10:
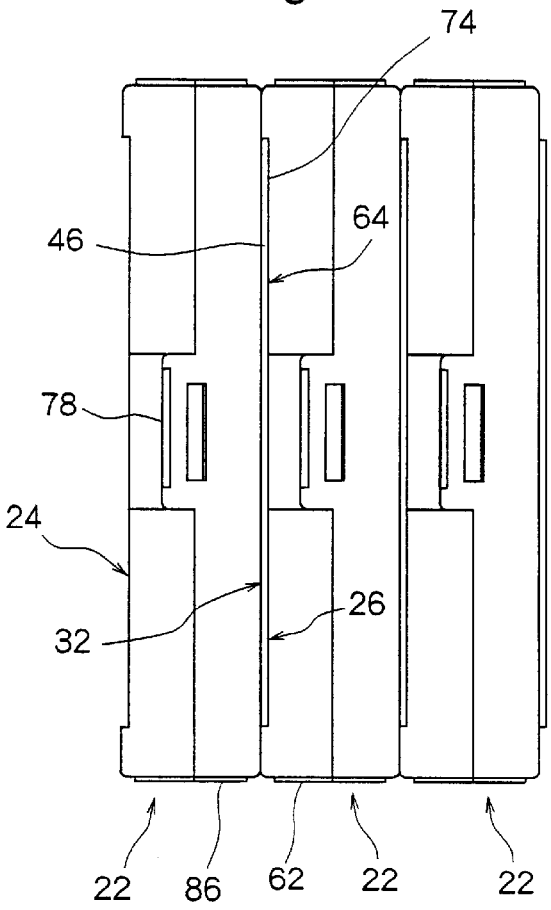
FIG. 10 is a front view showing that a plurality of the cases shown in FIG. 1 are arranged upright in a row.

A plurality of the cases 22 may be arranged in a row as shown in FIG. 10 by placing them upright. In this case, two adjacent cases 22 can be arranged close to each other by placing the protruding area 74 formed on the outer side of the main wall 64 of the second case member 26 of one case 22 in the sunken area 46 formed on the outer side of the main wall 32 of the fist case member 24 of the other case 22. Since the front end edge and rear end edge of the sunken area 46 are made open, a specific case 22 out of the plurality of cases 22 arranged in a row can be taken out by placing a finger on the protruding piece 78 formed at the front end of the second case member 26 and pulling it forward or by placing a finger on the recessed portion 60 formed at the rear end of the second case 26 and pulling it backward.

Figure 11:
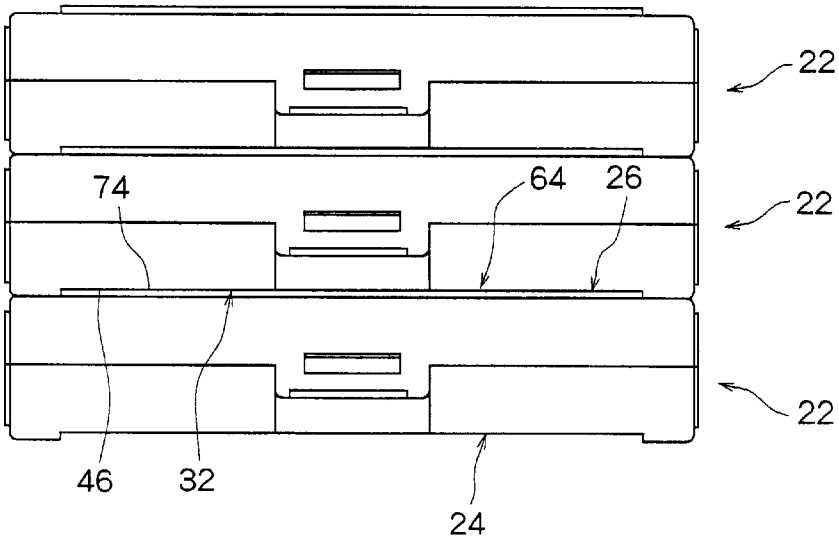
FIG. 11 is a front view showing that a plurality of the cases shown in FIG. 1 are piled up in a vertical direction.

As shown in FIG. 11, a plurality of the cases 2 may be piled up by placing them horizontally. In this case, the protruding area 74 formed on the outer side of the main wall 64 of the second case member 26 of one of adjacent cases 22 in a vertical direction is placed in the sunken area 46 formed on the outer side of the main wall 32 of the first case member 24 of the other case 22. Then, the dislocation in a horizontal direction of the cases 22 is prevented and the plurality of cases 22 can be piled up fully stably.

While the cases constituted according to the preferred embodiments of the present invention have been described with reference to the accompanying drawings, it should be understood that the present invention is not limited thereto and various changes and modifications may be made in the invention without departing from the spirit and scope thereof.

What is claimed is:

1. A case for storing a grinding wheel which comprises an annular support member having an upper end face, lower end face, outer side face and inner side face and a grinding means provided on the lower end face of the support member, wherein the case includes a first case member and a second case member, and the first case member and the second case member are connected to each other by a hinge member in such a manner that they can freely pivote relative to each other, and selectively set to a close state for defining a closed storage space in cooperation or to an open state for opening the storage space;

a receiving means is provided on the first case member and a restricting means is provided on the second case member; and when the upper end face of the support member is placed on the receiving means of the first case member by setting the first case member and the second case member to the open state and then the first case member and the second case member are set to the close state, the restricting means of the second case member contacts to either one of the inner side face, lower end face and outer side face of the support member, whereby the support member is held between the receiving means and the restricting means and the grinding wheel is stored in the storage space, without contacting the first case member and the second case member to the grinding means.

2. The case of claim 1, wherein the first case member, the second case member and the hinge member are each molded out of a transparent or semi-transparent synthetic resin as a single piece.

3. The case of claim 1, wherein the first case member has a main wall and a side wall protruding from the periphery of the main wall, a plurality of receiving pieces are arranged on the inner side of the main wall in a circumferential direction at intervals, and the top surfaces of the receiving pieces constitute the receiving means.

4. The case of claim 1, wherein the inner side face of the support member includes an inclined face which is inclined inward in a radial direction and extends from the lower end face toward the upper end face, the restricting means of the second case member has restricting faces which are inclined inward in a radial direction and extend toward the end, and the restricting faces are contacted to the inclined face of the support member.

5. The case of claim 1, wherein the second case member has a main wall and a side wall protruding from the periphery of the main wall, and the restricting means consists of a plurality of restricting pieces arranged on the inner side of the main wall in a circumferential direction at intervals.

6. The case of claim 1, wherein a first receiving means for receiving a support member having a relatively large thickness in a radial direction and a second receiving means for receiving a support member having a relatively small thickness in a radial direction are provided on the first case member, a first restricting means to be contacted to either one of the inner side face, lower end face and outer side face of the support member having a relatively large thickness in a radial direction is provided on the second case member, and an auxiliary member constituting a second restricting means to be contacted to either one of the inner side face, lower end face and outer side face of the support member having a relatively small thickness in a radial direction is set in the second case member detachably.

7. The case of claim 6, wherein the first case member has a main wall and a side wall protruding from the periphery of the main wall, a plurality of receiving pieces are arranged on the inner side of the main wall in a circumferential direction at intervals, a storage groove is formed in a center portion of the top surface of each of the receiving pieces, the top surfaces of the receiving pieces constitute the first receiving means, and the storage grooves of the receiving pieces constitute the second receiving means.

8. The case of claim 1, wherein the first case member has a main wall which has a semicircular front half portion and a rectangular rear half portion continuous to a linear site of the front half portion and a side wall protruding from the periphery of the main wall, the second case member also has a main wall which has a semicircular front half portion and a rectangular rear half portion continuous to a linear site of the front half portion, correspondingly to the main wall of the first case member, and a side wall protruding from the periphery of the main wall, and the hinge member connects an upper end portion of the rear end of the side wall of the first case member to an upper end portion of the rear end of the side wall of the second case member.

9. The case of claim 8, wherein a locking means is provided on a front end portion of the side wall of the first case member and a front end portion of the side wall of the second case member to lock the case releasably to set, in cooperation with each other, the first case member and the second member to the close state.

10. The case of claim 8, wherein when the grinding wheel is stored in the storage space and the first case member and the second case member are set to the close state, the center of gravity of the case storing the grinding wheel is located behind the semicircular geometrical center of the front half portion of the main wall of the first case member and the front half portion of the main wall of the second case member.

11. The case of claim 8, wherein rotation prevention elongated ribs are provided on the outer side of the both side linear portions of the side wall of the first case member and/or the outer side of the both side linear portions of the side wall of the second case member.

12. The case of claim 8, wherein a protruding area whose both sides are linear is formed on either one of the outer side of the main wall of the first case member and the outer side of the main wall of the second case member, and a sunken area whose both sides are linear and whose front end and rear end are made open is formed on the opposite side corresponding to the protruding area.

* * * * *